US007000413B2

(12) United States Patent
Chen et al.

(10) Patent No.: US 7,000,413 B2
(45) Date of Patent: Feb. 21, 2006

(54) CONTROL OF REFRIGERATION SYSTEM TO OPTIMIZE COEFFICIENT OF PERFORMANCE

(75) Inventors: Yu Chen, East Hartford, CT (US); Lili Zhang, East Hartford, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/607,283

(22) Filed: Jun. 26, 2003

(65) Prior Publication Data

US 2004/0261435 A1 Dec. 30, 2004

(51) Int. Cl.
*F25B 41/04* (2006.01)

(52) U.S. Cl. ..... 62/225; 62/190; 62/222; 62/224

(58) Field of Classification Search ..... 62/222, 62/223, 224, 225, 209, 126, 129, 190, 183, 62/184, 214, 298
See application file for complete search history.

(56) References Cited

U.S. PATENT DOCUMENTS 4,205,532 A * 6/1980 Brenan ..... 62/115
4,432,232 A * 2/1984 Brantley et al. ..... 73/865.9
4,510,576 A * 4/1985 MacArthur et al. ..... 702/182
4,611,470 A * 9/1986 Enstrom ..... 62/127
4,768,346 A * 9/1988 Mathur ..... 62/127
4,885,914 A * 12/1989 Pearman ..... 62/129
6,230,506 B1 * 5/2001 Nishida et al. ..... 62/223
6,505,476 B1 * 1/2003 Nishida et al. ..... 62/228.5
6,568,199 B1 * 5/2003 Manohar et al. ..... 62/223
6,701,725 B1 * 3/2004 Rossi et al. ..... 62/125

FOREIGN PATENT DOCUMENTS

JP 2001133058 5/2001
WO WO 03/019085 3/2003

OTHER PUBLICATIONS

International Search Report dated Apr. 14, 2005.

* cited by examiner

*Primary Examiner*—Marc Norman
(74) *Attorney, Agent, or Firm*—Carlson, Gaskey & Olds

(57) ABSTRACT

A refrigeration system includes a compressor, a gas cooler, an expansion device, and an evaporator. Refrigerant is circulated though the closed circuit system. Preferably, carbon dioxide is used as the refrigerant. As carbon dioxide has a low critical point, systems utilizing carbon dioxide as a refrigerant usually require the refrigeration system to run transcritical. When the system is operating inefficiently, the system is modified so the system operates efficiently. First, a parameter of the system is monitored by a sensor and the then compared to a stored value to determine if the system is operating inefficiently. If the system is operating inefficiently, the system is modified to an efficient system.

19 Claims, 2 Drawing Sheets

CONTROL OF REFRIGERATION SYSTEM TO OPTIMIZE COEFFICIENT OF PERFORMANCE

BACKGROUND OF THE INVENTION

The present invention relates generally to a system control strategy for a refrigeration system that achieves an optimal coefficient of performance by monitoring a system parameter and then adjusting the water flow rate through the gas cooler or the opening of the expansion device when the system parameter indicates that the system is running inefficiently to transfer the system top an efficient system.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Carbon dioxide has a low critical point, which causes most air conditioning systems utilizing carbon dioxide to run partially above the critical point, or to run transcritical, under most conditions. The pressure of any subcritical fluid is a function of temperature under saturated conditions (when both liquid and vapor are present). However, when the temperature of the fluid is higher than the critical temperature (supercritical), the pressure becomes a function of the density of the fluid.

In a transcritical refrigeration system, the refrigerant is compressed to a high pressure and high temperature in the compressor. As the refrigerant enters the gas cooler, heat is removed from the refrigerant and transferred to a fluid medium, such as water. The refrigerant is then expanded in an expansion device. The opening of the expansion device can be controlled to regulate the high side pressure to achieve the optimal coefficient of performance. The refrigerant then passes through an evaporator and accepts heat from air. The superheated refrigerant then re-enters the compressor, completing the cycle. The environmental working conditions of the system are defined by the ambient air temperature at the evaporator inlet, the supply water temperature to the gas cooler, and the water delivery temperature to a storage tank.

If the coefficient of performance of the system decreases, the efficiency of the system decreases. It is desirable that the system be monitored to determine when the system is operating inefficiently, and then adjusted to increase the coefficient of performance.

SUMMARY OF THE INVENTION

A transcritical refrigeration system includes a compressor, a gas cooler, an expansion device, and an evaporator. Refrigerant is circulated through the closed circuit system. Preferably, carbon dioxide is used as the refrigerant. As carbon dioxide has a low critical point, systems utilizing carbon dioxide as a refrigerant usually require the refrigeration system to run transcritical.

A sensor monitors a parameter of the system and then compares the sensed value to a threshold value stored in a control to determine if the system is operating inefficiently. If the system is operating inefficiently, the system is modified to change the system to an efficient system.

The parameter can be the refrigerant temperature or the refrigerant enthalpy at the refrigerant outlet of the gas cooler, the refrigerant pressure drop across the gas cooler, or the water flow rate through the heat sink of the gas cooler.

Alternately, the approach temperature of the system is detected. The suction pressure of the compressor or the refrigerant temperature at the discharge of the compressor can also be monitored. The parameter can also be the opening of the expansion device or the refrigerant quality at the inlet of the evaporator. The coefficient of performance and the mass flow rate of the system can also be detected to determine if the system is operating inefficiently.

If it is determined that the system is operating inefficiently, the system is transferred to an efficient cycle by either adjusting the water flow rate through the heat sink of the gas cooler or by adjusting the opening of the expansion device.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
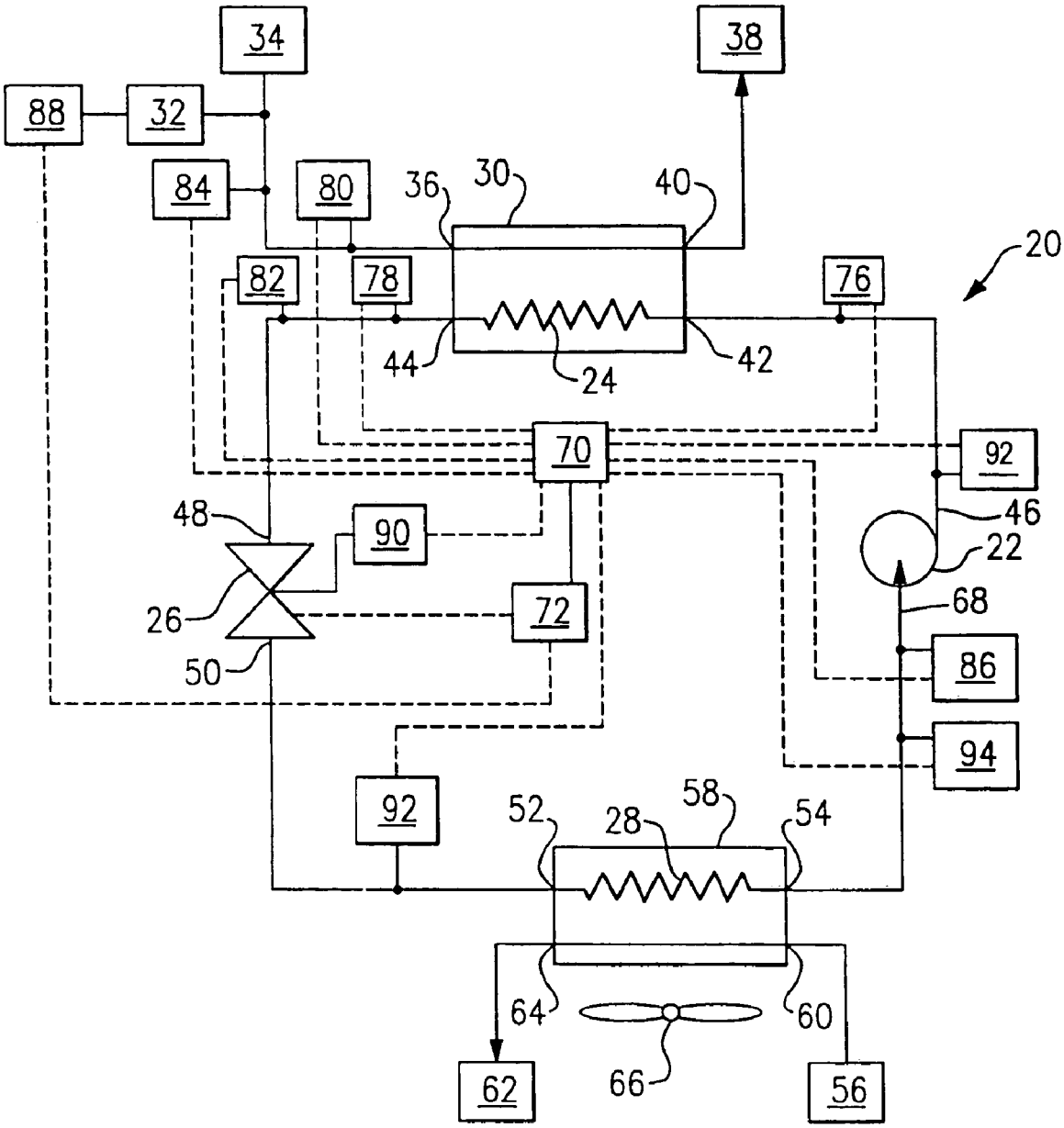
FIG. 1 schematically illustrates a diagram of the refrigeration system of the present invention.

FIG. 1 illustrates a refrigeration system 20 including a compressor 22, a heat rejecting heat exchanger (a gas cooler in transcritical cycles) 24, an expansion device 26, and an evaporator (an evaporator) 28. Refrigerant circulates though the closed circuit cycle 20. Preferably, carbon dioxide is used as the refrigerant. Although carbon dioxide is described, other refrigerants may be used. Because carbon dioxide has a low critical point, systems utilizing carbon dioxide as a refrigerant usually require the refrigeration system 20 to run transcritical.

When operating in a water heating mode, the refrigerant exits the compressor 22 at high pressure and enthalpy through a compressor discharge 46. The refrigerant then flows through the gas cooler 24 and loses heat, exiting the gas cooler 24 at low enthalpy and high pressure. In the gas cooler 24, the refrigerant rejects heat to a fluid medium, such as water, heating the fluid medium. A variable speed water pump 32 pumps the fluid medium through the heat sink 30 and is controlled to vary the water flow rate through the gas cooler 24. The cooled fluid 34 enters the heat sink 30 at the heat sink inlet or return 36 and flows in a direction opposite to the flow of the refrigerant. After exchanging heat with the refrigerant, the heated water 38 exits at the heat sink outlet or supply 40. The refrigerant enters the gas cooler 24 through a gas cooler refrigerant inlet 42 and exits through a gas cooler refrigerant outlet 44.

The refrigerant is then expanded to a low pressure in the expansion device 26. The expansion device 26 can be an electronic expansion valve (EXV) or other type of expansion device 26. The refrigerant enters the expansion device 26 through an expansion inlet 48 and exits through an expansion outlet 50. The opening of the expansion device 26 can be controlled to regulate the high side pressure to achieve the optimal coefficient of performance.

After expansion, the refrigerant enters the evaporator 28 through an evaporator inlet 52. In the evaporator 28, outdoor air rejects heat to the refrigerant. Outdoor air 56 flows through a heat sink 58 and exchanges heat with the refrigerant flowing through the evaporator 28. The outdoor air enters the heat sink 58 through a heat sink inlet or return 60 and flows in a direction opposite to, or cross, the flow of the refrigerant. After exchanging heat with the refrigerant, the cooled outdoor air 62 exits the heat sink 58 through a heat sink outlet or supply 64. The refrigerant exits the evaporator outlet 54 at high enthalpy and low pressure. A fan 66 moves the outdoor air across the evaporator 28. The refrigerant then reenters the compressor 22 at the compressor suction 68, completing the cycle.

Figure 2:
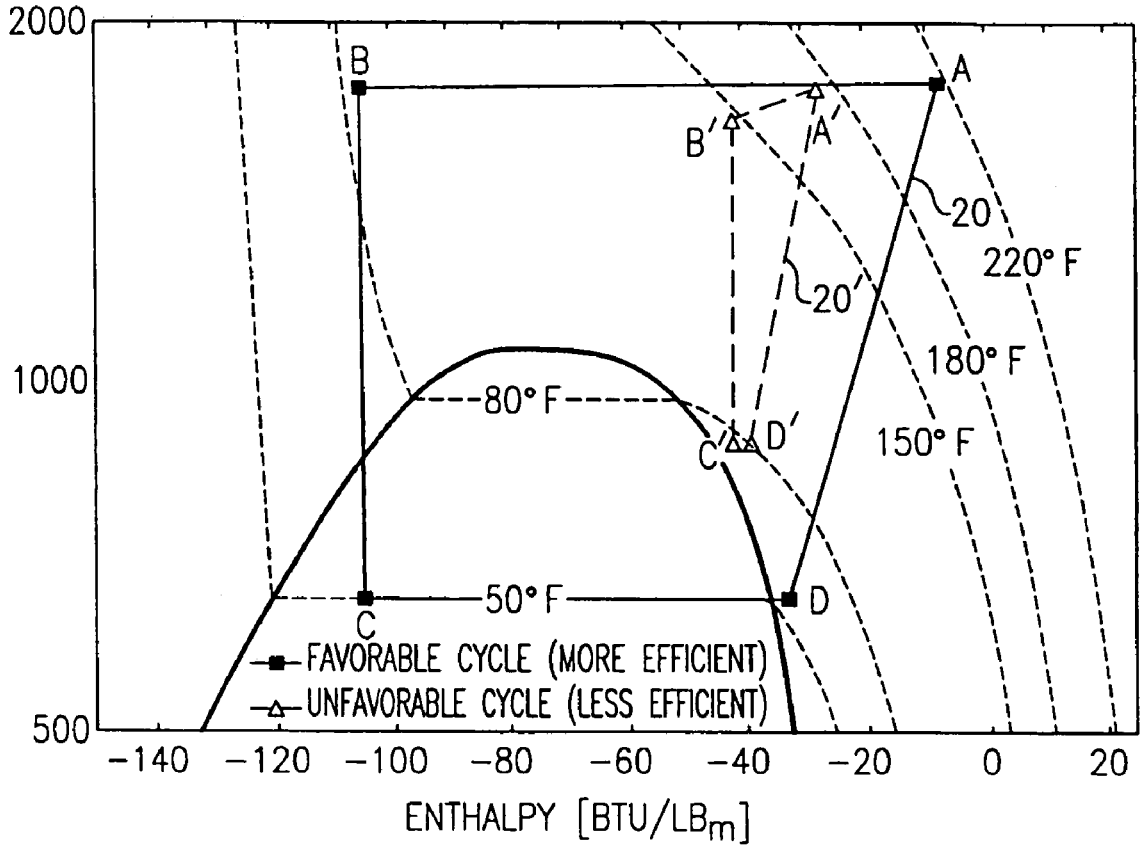
FIG. 2 schematically illustrates a thermodynamic diagram of a transcritical refrigeration system during an efficient cycle and an inefficient cycle.

FIG. 2 schematically illustrates a diagram of a refrigeration system 20. During efficient operation, the vapor refrigerant exits the compressor 22 at high pressure and enthalpy, shown by point A. As the refrigerant flows through the gas cooler 24 at high pressure, it loses heat and enthalpy to the water, exiting the gas cooler 24 with low enthalpy and high pressure, indicated as point B. As the refrigerant passes through the expansion valve 26, the pressure drops to point C. The refrigerant passes through the evaporator 28 and exchanges heat with the outdoor air, exiting at a high enthalpy and low pressure, represented by point D. The refrigerant is then compressed in the compressor 22 to high pressure and high enthalpy, completing the cycle.

FIG. 2 also illustrates a system 20 operating in a less efficient unfavorable cycle. The less efficient system 20 operates at the same environmental working conditions, the same compressor 22 discharge pressure, and the same water temperature at the heat sink inlet or return 36 and heat sink outlet or supply 40 of the gas cooler 24 as the above-described efficient system 20. However, the inefficient system 20 has a lower water flow rate through the gas cooler 24, a higher compressor 22 suction pressure, a lower compressor 22 discharge temperature, and a higher overall refrigerant flow rate through the system 20.

In an inefficient system 20, the opening of the expansion device 26 is greater than that of the expansion device 26 in the efficient system 20 due to the lower pressure drop across the expansion device 26 and the higher refrigerant flow rate. The refrigerant temperature at the outlet 44 of the gas cooler 24 is also higher because the increased refrigerant flow rate reduces heat transfer in the gas cooler 24. The refrigerant in the evaporator 28 also absorbs less heat from the ambient air because the refrigerant at the inlet 52 of the evaporator is already saturated or superheated.

When the system 20 is operating inefficiently, the system 20 needs to be modified to operate efficiently. A parameter of the system 20 is monitored by a sensor 70 to determine if the system 20 is operating inefficiently. If the system 20 is operating inefficiently, the system 20 is modified by adjusting the water flow rate through the heat sink 30 of the gas cooler 24 or by adjusting the opening of the expansion device 26.

Several parameters of the system 20 can be monitored to determine if the system 20 is operating inefficiently. The sensor 70 senses various parameters of the system 20 that are representative of a state of efficiency of the system 20. A threshold value of the parameter representative of an efficient system 20 is stored in the control 72. The value sensed by the sensor 70 and the threshold value stored in the control 72 are compared to determine the state of efficiency of the system.

In a first example, the sensor 70 senses the refrigerant temperature at the refrigerant outlet 44 of the gas cooler 24. A temperature sensor 82 detects the temperature of the refrigerant exiting the gas cooler 24 and provides this value to the sensor 70. A value of the refrigerant temperature at the refrigerant outlet 44 of the gas cooler 24 when the system 20 is operating efficiently is stored in the control 72. When the sensor 70 senses that the refrigerant temperature at the outlet 44 of the gas cooler 24 is significantly higher than the value stored in the control 72, the system 20 is operating inefficiently.

In another example, the refrigerant enthalpy at the refrigerant outlet 44 of the gas cooler 24 is computed. The refrigerant enthalpy is computed based on the temperature and the pressure of the refrigerant exiting the gas cooler 24. The temperature of the refrigerant exiting the gas cooler 24 is detected by a temperature sensor 82, and the pressure of the refrigerant exiting the gas cooler 24 is detected by a pressure sensor 78. These detected values are provided to the sensor 70. A saturation enthalpy corresponding to the refrigerant pressure at the outlet 50 of the expansion device 26 or the refrigerant pressure at the inlet 52 or outlet 54 of the evaporator 28 during an efficient cycle is stored in the control 72. When the refrigerant enthalpy at the refrigerant outlet 44 of the gas cooler 24 is sensed to be close to or higher than the value stored in the control 72, the system 20 is operating inefficiently.

Alternately, the sensor 70 senses the refrigerant pressure drop across the gas cooler 24. A pressure sensor 76 senses the pressure of the refrigerant entering the gas cooler 24 and a pressure sensor 78 senses the pressure of the refrigerant exiting the gas cooler 24. The sensor 70 detects the values sensed by the sensors 76 and 78 and determines the pressure drop across the gas cooler 24. A value of the refrigerant pressure drop across the gas cooler 24 when the system 20 is operating efficiently is stored in the control 72. During an inefficient cycle, the refrigerant pressure drop across the gas cooler 24 is higher than an efficient cycle due to the high mass flow rate of refrigerant. When the sensor 70 detects that the refrigerant pressure drop across the gas cooler 24 is significantly higher than the value stored in the control 72, the system 20 is operating inefficiently.

The sensor 70 can also detect the water flow rate through the heat sink 30 of the gas cooler 24. A water flow rate sensor 84 detects the water flow rate through the heat sink 30 of the gas cooler 24 and provides this value to the sensor 70. The water flow rate sensor 84 can be located before or after the gas cooler 24. A value of the water flow rate through the heat sink 30 of the gas cooler 24 when the system 20 is operating efficiently is stored in the control 72. When the sensor 70 detects that the water flow rate through the heat sink 30 of the gas cooler 24 is significantly lower than the value stored in the control 72, the system 20 is operating inefficiently.

In another example, the sensor 70 detects the approach temperature of the system 20. The approach temperature is the difference between the refrigerant at the refrigerant outlet 44 of the heat sink 30 of the gas cooler 24 and the water at the inlet 36 of the heat sink 30 of the gas cooler 24. A temperature sensor 80 detects the temperature of the water entering the heat sink 30, a temperature sensor 82 detects the temperature of the refrigerant exiting the heat sink 30. The sensor 70 detects the values sensed by the sensors 80 and 82 and determines the approach temperature. The approach temperature of an efficient cycle is stored in the control 72. When the approach temperature detected by the sensor 70 is significantly higher than the value stored in the control 72, the system 20 is operating inefficiently.

The sensor 70 can also detect the suction pressure at the compressor suction 68 of the compressor 22. The suction pressure at the compressor suction 68 of the compressor 22 is sensed by a pressure sensor 86, and this value is provided to the sensor 70. A value of the suction pressure of the compressor 22 when the system 20 is operating efficiently is stored in the control 72. When the sensor 70 detects that the suction pressure of the compressor 22 is significantly higher than the value stored in the control 72, the system 20 is operating inefficiently.

In another example, the temperature of the refrigerant at the discharge 46 of the compressor 22 is detected by the sensor 70. The temperature of the refrigerant at the discharge 46 of the compressor 22 is detected by a temperature sensor 92 and provided to the sensor 70. A value of the refrigerant temperature at the discharge 46 of the compressor 22 when the system 20 is operating efficiently is stored in the control 72. If the refrigerant temperature is significantly lower than the value stored in the control 72, the system 20 is operating inefficiently.

The sensor 70 can also detect the opening of the expansion device 26. A sensor 90 senses the size of the opening of the expansion device 26 and provides this information to the sensor 70. A value of the opening of the expansion device 26 when the system 20 is operating efficiently is stored in the control 72. When the sensor 70 detects that the opening of the expansion device 26 is significantly higher than the value of an efficient cycle stored in the control 72, the system 20 is operating inefficiently.

The refrigerant quality (vapor mass fraction) at the inlet 52 of the evaporator 28 can also be detected to determine if the system 20 is operating inefficiently. A sensor 90 detects the refrigerant quality at the inlet 52 of the evaporator 28 and provides this value to the sensor 70. A value of the refrigerant quality at the inlet 52 of the evaporator 28 when the system 20 is operating efficiently is stored in the control 72. When the sensor 70 detects that the refrigerant quality at the inlet 52 of the evaporator 28 is significantly higher than the value stored in the control 72, the system 20 is running inefficiently.

The sensor 70 can also sense the coefficient of performance. The coefficient of performance is defined as the heating capacity divided by the power input. A value of the coefficient of performance when the system 20 is operating efficiently is stored in the control 72. When the sensor 70 detects that the coefficient of performance is significantly lower than the value of an efficient cycle stored in the control 72, the system 20 is operating inefficiently.

Finally, the sensor 70 can also sense the refrigerant mass flow rate of the system 20. A sensor 94 detects the refrigerant mass flow rate at any point of the system 20 and provides this value to the sensor 70. A value of the refrigerant mass flow rate when the system 20 is operating efficiently is stored in the control 72. When the sensor 70 detects that the refrigerant mass flow rate of the system 20 is significantly higher than the value stored in the control 72, the system 20 is operating inefficiently.

Once the system 20 has been determined to be operating inefficiently, the system 20 is transferred to an efficient cycle. However, when a refrigeration system 20 is in a steady state, while operating either efficiently or inefficiently, the system 20 is stable. Therefore, a control algorithm needs to be applied to break the steady state and transfer the inefficient system to an efficient system 20.

In one example, the system 20 is transferred to an efficient cycle by increasing the water flowrate through the heat sink 30 of the gas cooler 24. A drive 88 coupled to the water pump 32 controls the water flowrate through the gas cooler 24. When the sensor 70 detects that the system 20 is operating inefficiently, the control 72 sends a signal to the drive 88 to increase the water flow rate through the heat sink 30 of the gas cooler 24, improving heat transfer in the gas cooler 24. The refrigerant temperature at the refrigerant outlet 44 of the gas cooler 24 decreases, increasing the liquid mass fraction of the refrigerant at the inlet of the evaporator 28, increasing the evaporator 28 load, and decreasing the evaporating pressure. Both the suction pressure of the compressor 22 and the discharge pressure of the compressor 22 are lowered. If the opening of expansion device 26 is automatically controlled (decreased) to maintain the high pressure, the pressure ratio increases, decreasing the mass flow rate. The compressor 22 discharge increases, transferring the system 20 to an efficient system 20.

The system 20 can also be transferred to an efficient system 20 by decreasing the opening of the expansion device 26. By reducing the opening of the expansion device 26, the discharge pressure of the compressor 22 increases, increasing the discharge temperature of the compressor 22. If the water pump 32 speed is automatically controlled (increased), the water flow rate through the heat sink 30 increases. Therefore, by decreasing the opening of the expansion device 26, the system 20 is transferred to an efficient system 20.

Both methods of transfer can be employed separately or simultaneously to transfer the system 20 to an efficient system 20.

To prevent an inefficient system 20, the opening of the expansion device 26 during start up of the system 20 should be lower than 1.25 times the opening of the expansion device 26 during the last steady state efficient operation.

Additionally, the water delivery temperature set point can be lowered during startup and warmup stages. After the system 20 is running efficiently and steadily, the delivery temperature can be gradually increased to heat the water to the desirable temperature and achieve a steady state. Therefore, an inefficient system 20 can be avoided during the startup and warmup state.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A method of optimizing a coefficient of performance of a refrigeration system comprising the steps of:

compressing a refrigerant to a high pressure in a compressor device;

cooling said refrigerant in a heat rejecting heat exchanger;

expanding said refrigerant to a low pressure in an expansion device;

evaporating said refrigerant in a heat accepting heat exchanger;

sensing a parameter of said refrigeration system;

comparing said parameter to an efficiency parameter representative of an efficient refrigeration system;

determining a state of efficiency of the refrigeration system based on the step of comparing; and adjusting said refrigeration system if the step of determining said state of efficiency determines that the refrigeration system is operating at an inefficient state to optimize the coefficient of performance.

2. The method as recited in claim 1 wherein said refrigerant is carbon dioxide.

3. The method as recited in claim 1 wherein said parameter is an outlet temperature of said refrigerant exiting said heat rejecting heat exchanger.

4. The method as recited in claim 1 wherein said parameter is an outlet enthalpy of said refrigerant exiting said heat rejecting heat exchanger.

5. The method as recited in claim 1 wherein said parameter is a pressure difference between a first pressure of said refrigerant entering said heat rejecting heat exchanger and a second pressure of said refrigerant exiling said heat rejecting heat exchanger.

6. The method as recited in claim 1 wherein said parameter is a flow rate of fluid that exchanges heat with said refrigerant in said heat rejecting heat exchanger.

7. The method as recited in claim 1 wherein said parameter is a suction pressure of said refrigerant entering said compressor device.

8. The method as recited in claim 1 wherein said parameter is a temperature of said refrigerant exiting said compressor device.

9. The method as recited in claim 1 wherein said parameter is a size of an opening of said expansion device.

10. The method as recited in claim 1 wherein said parameter is a quality of said refrigerant entering said heat accepting heat exchanger.

11. The method as recited in claim 1 wherein said parameter is a coefficient of performance of the refrigeration system.

12. The method as recited in claim 1 wherein said parameter is a refrigerant mass flow rate of the refrigeration system.

13. The method as recited in claim 1 wherein the step of adjusting said refrigeration system includes increasing a flow rate of a fluid flowing through said heat rejecting heat exchanger that exchanges heat with said refrigerant.

14. The method as recited in claim 1 wherein the step of adjusting said refrigeration system includes increasing a size of an opening of said expansion device.

15. The method as recited in claim 1 wherein a fluid exchanges heat with said refrigerant in said heat rejecting heat exchanger, and said fluid is water.

16. A method of optimizing a coefficient of performance of a refrigeration system comprising the steps of:

compressing a refrigerant to a high pressure in compressor device;

cooling said refrigerant in a heat injecting heat exchanger;

expanding said refrigerant to a low pressure in an expansion device;

evaporating said refrigerant in a heat accepting heat exchanger;

sensing a parameter of said refrigeration system, wherein said parameter is a temperature difference between refrigerant temperature of said refrigerant exiting said heat rejecting heat exchanger and a fluid temperature of a fluid entering said heat rejecting heat exchanger that exchanges heat with said refrigerant in said heat rejecting heat exchanger;

comparing said parameter to an efficiency parameter representative of an efficient refrigeration system;

determining a state of efficiency of the refrigeration system; and adjusting said refrigeration system if the step of determining said state of efficiency determines that the refrigeration system is operating at an inefficient state.

17. A transcritical refrigeration system comprising:

a compression device to compress a refrigerant to a high pressure;

a heat rejecting heat exchanger for cooling said refrigerant;

an expansion device for reducing said refrigerant to a low pressure;

a heat accepting heat exchanger for evaporating said refrigerant;

a sensor to sense a parameter of the refrigerant system; and a control that stores an efficiency value of said parameter representative of an efficient state of the refrigeration system, compares said efficiency value to said parameter to determine a state of efficiency the refrigeration system, and adjusts the refrigeration system if the refrigeration system is determined to be operating in an inefficient state to optimize a coefficient of performance of the system.

18. The system as recited in claim 17 wherein said parameter is a temperature difference between a refrigerant temperature of said refrigerant exiting said heat rejecting heat exchanger and a fluid temperature of a fluid entering said heat rejecting heat exchanger that exchanges heat with said refrigerant in said heat rejecting heat exchanger.

19. The system as recited in claim 17 wherein a fluid exchanges heat with said refrigerant in said heat rejecting heat exchanger, and said fluid is water.

* * * * *

UNITED STATES PATENT AND TRADEMARK OFFICE

CERTIFICATE OF CORRECTION

PATENT NO. : 7,000,413 B2
APPLICATION NO. : 10/607283
DATED : February 21, 2006
INVENTOR(S) : Yu Chen and Lili Zhang It is certified that error appears in the above-identified patent and that said Letters Patent is hereby corrected as shown below:

Column 7, Line 48:
Please insert "a" after --in--

Column 8, Line 1:
Please delete "injecting" and insert --rejecting--

Signed and Sealed this

Fifth Day of September, 2006

JON W. DUDAS
*Director of the United States Patent and Trademark Office*